US006478719B2

(12) United States Patent
Chen

(10) Patent No.: US 6,478,719 B2
(45) Date of Patent: Nov. 12, 2002

(54) FOOT-PEDAL TYPE BODY EXERCISER

(76) Inventor: Chao-Chuan Chen, No. 15, Lane 9, Cheng Kuang Road, Chin Rong Village, Wu Feng, Taichung (TW)

( * ) Notice: Subject to any disclaimer, the term of this patent is extended or adjusted under 35 U.S.C. 154(b) by 0 days.

(21) Appl. No.: 09/767,710

(22) Filed: Jan. 24, 2001

(65) Prior Publication Data

US 2002/0098950 A1 Jul. 25, 2002

(51) Int. Cl.[7] ..... A63B 22/04
(52) U.S. Cl. ..... 482/52; 482/51
(58) Field of Search ..... 482/51, 52, 53, 482/57, 79, 80

(56) References Cited

U.S. PATENT DOCUMENTS 4,563,001 A * 1/1986 Terauds ..... 482/53
5,676,623 A * 10/1997 Yu ..... 482/53
5,746,681 A * 5/1998 Bull ..... 482/53
5,865,712 A * 2/1999 Chang ..... 482/57

* cited by examiner

*Primary Examiner*—Stephen R. Crow
(74) *Attorney, Agent, or Firm*—Browdy and Neimark, P.L.L.C.

(57) ABSTRACT

A foot-pedal type body exerciser includes a base frame: a resistance device provided on the base frame; two first movement members with one end pivotally provided on the base frame and capable of reciprocating movement along a predetermined track, each of the first movement members being provided with a guiding portion; two second movement members pivotally provided on the two first movement members, the guiding portion on each of the first and movement members corresponding to each other such that each of the second movement members are capable of limited reciprocating movement relative to each of the first movement members; and two linkage members having one end pivotally provided on the base frame, the other end thereof being pivotally provided on the two second movement members such that when each of the first movement members displaces. each of the linkage members can bring the two second movement members to displace to thereby increase the range of movement of the body exerciser.

4 Claims, 3 Drawing Sheets

FOOT-PEDAL TYPE BODY EXERCISER

BACKGROUND OF THE INVENTION (a) Field of the Invention

The invention relates generally to a foot-pedal type body exerciser, more particularly to a foot-pedal type body exercise that can exercise relatively more parts of the body.

(b) Description of the Prior Art

A conventional foot-pedal type body exerciser can allow the user to exercise only some parts of the body. For instance, an exercise hiker provides merely a linear up and down track of movement to allow the user to exercise mainly the calf muscles. As for exercising bikes, they provide merely a circular track of movement to permit the user to exercise the calf muscles and parts of the thigh muscles. But as a matter of fact, the lower trunk of the bode includes the hip muscles. There is available a kind of elliptical apparatus adapted for exercising hip muscles. However. it is complicated in construction and costly, and is therefore not popular.

SUMMARY OF THE INVENTION

The primary object of the invention is to provide a foot-pedal type body exerciser that can enable the user to exercise more parts of his body.

In order to achieve the object, the body exercise of this invention includes a base frame; at least one first movement member. one end of which is pivotally provided on the base frame such that it can move reciprocating along a predetermined track, each of the first movement members being provided with at least one guiding portion; at least one resistance device provided on the base frame to provide a resistance to each of the first movement members; at least one second movement member provided on each of the first movement member and adapted to be stepped on by the user's feet so as to bring each of the first movement members to displace along the predetermined track; each of the second movement members having a guiding portion corresponding to the guiding portion of each of the first movement members such that each of the second movement members is capable of limited reciprocating displacement relative to each of the first movement members; and at least one linkage member having one end provided on each of the second movement members, the other end thereof being provided at a predetermined position on the body exerciser such that when the user steps on each of the second movement members, each of the linkage members can bring each of the second movement members to displace relative to each of the first movement members.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
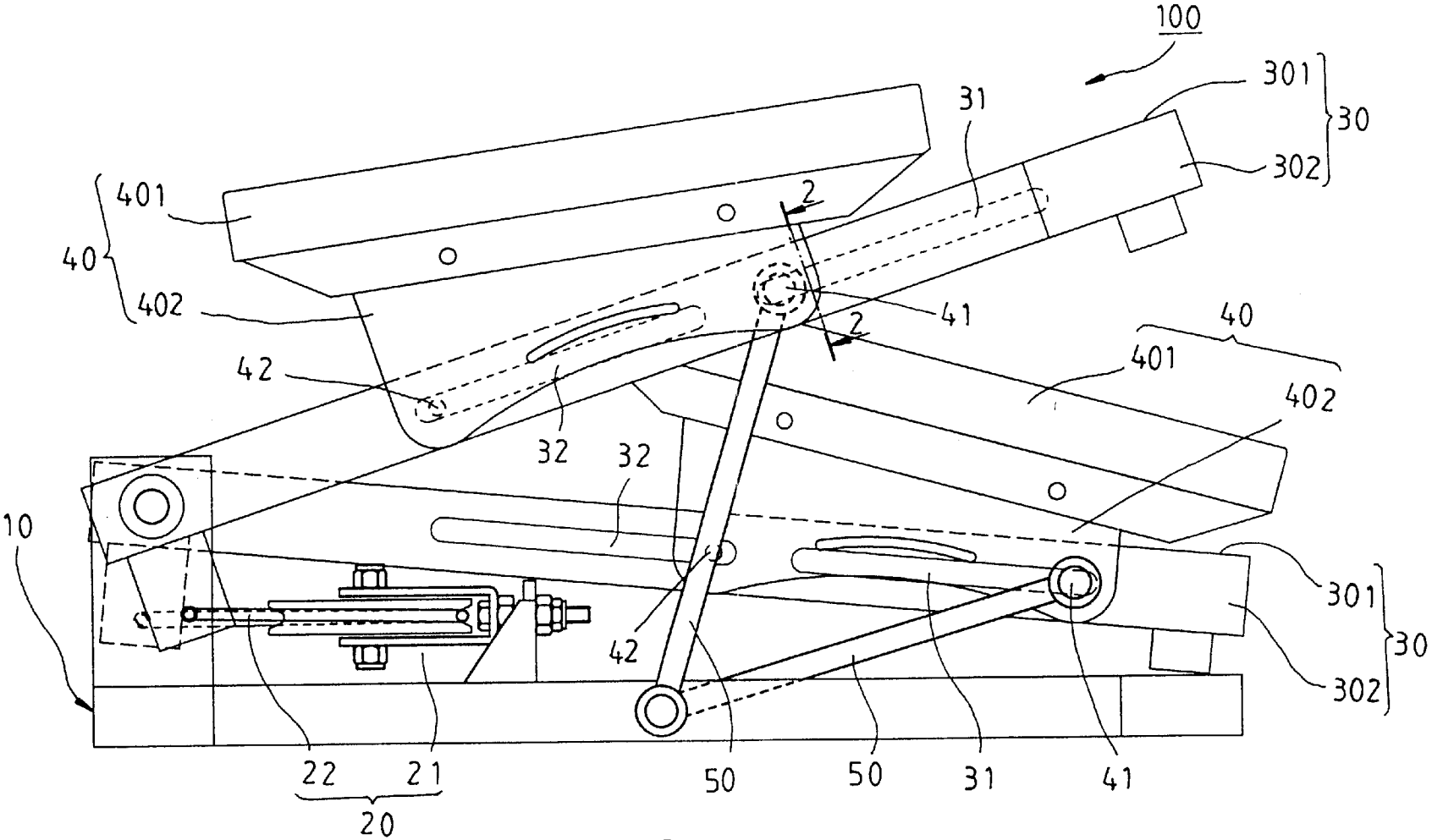
FIG. 1 is a front view of the preferred embodiment of the invention.
Figure 2:
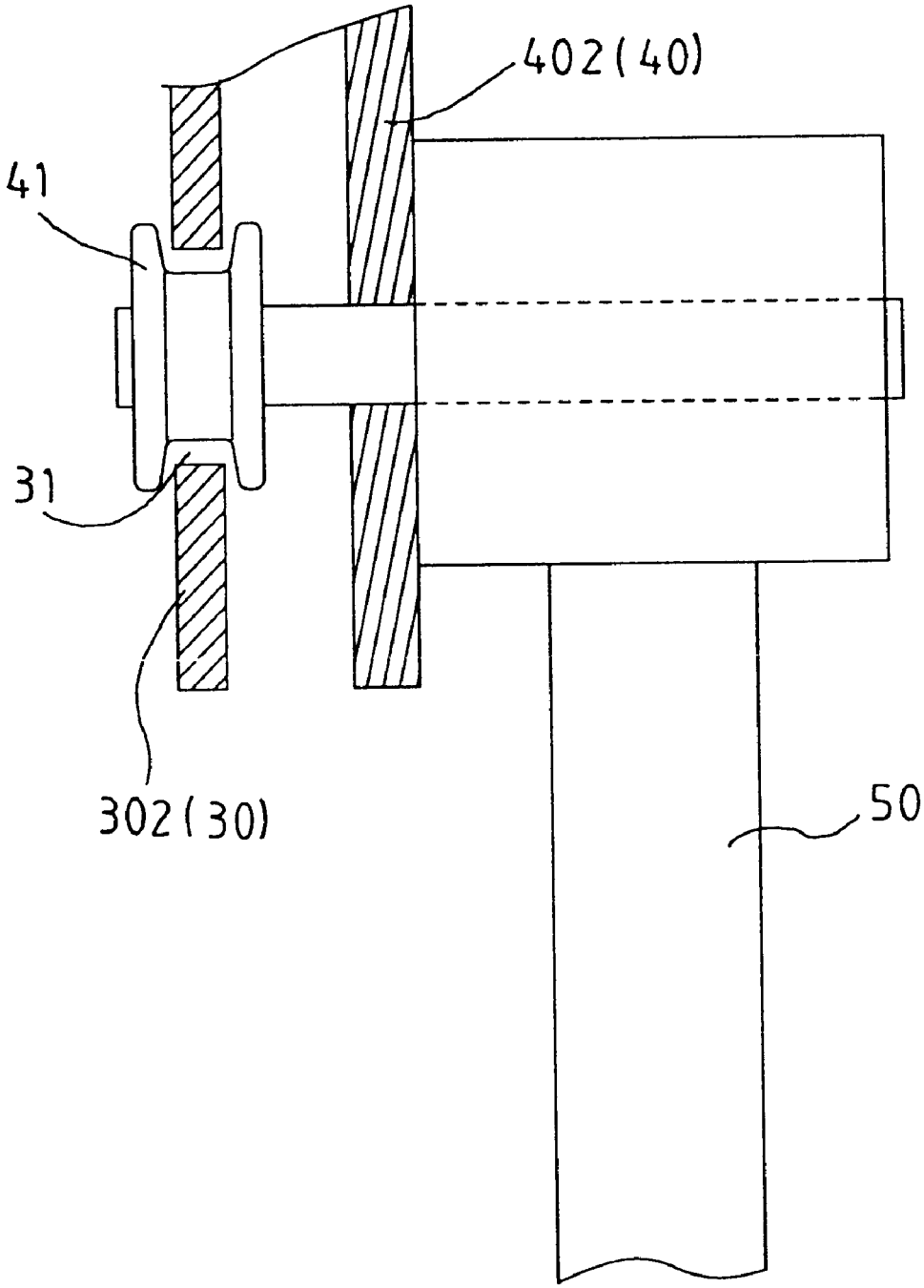
FIG. 2 is a sectional view of the invention taken along line 2—2 of FIG. 1.

With reference to FIGS. 1 and 2, the preferred embodiment of a foot-pedal type body exerciser of the invention is embodied in an exercise hiker 100. The exercise hiker 100 includes a base frame 10. a resistance device 20, two first movement members 30, two second movement members 40 and two linkage members 50.

The base frame 10 is the main body of the exercise hiker 100 so that it can be placed on any planar surface. The resistance device 20 is disposed to provide the exercise hiker 100 with a resistance which the user has to overcome using his muscle force so as to achieve an exercising effect. The resistance device 20 includes a damping belt pulley unit 21 and a belt 22. The two ends of the belt 22 are respectively connected to the two first movement members 30 such that each of the first movement members 30 can move up and down relatively under the state of being subjected to resistance. The resistance device 20 may be a hydraulic damping structure. As the aforesaid is known in the art and is not a feature of the invention, a detailed description thereof is dispensed with herein.

Each of the first movement members 30 is substantially an elongate plate member having a top plate 301 and two side plates 302 extending downwardly from two sides of the top plate 301. The side plates 301 on the inner side of each of the first movement members 30 are respectively provided w with a first guiding portion 31 and a second guiding portion 32. These guiding portions 31, 32 are elongate guide grooves. One end of each of the first movement members 30 is pivotally provided at a predetermined position on the base frame 10, and is connected to the resistance device 20 such that each of the first movement members 30 can move up and down with the pivotal connection as axis.

The top end of each of the second movement members 40 has a generally rectangular pedal 401 for stepping by the user. The lower side of the pedal 401 has two substantially parallel connecting plates 402 extending therefrom. The one at the left side is higher than the one at the right. The two connecting plates 402 respectively correspond to the outer sides of the two side plates of the respective first movement member 30 such that the pedals 401 of the second movement members 40 form a predetermined angle with the top plates 301 of the first movement members 30. The inner sides of the connecting plates 402 are each provided with first and second guiding portions 41, 42. These guiding portions 41, 42 are pulleys pivotally provided on the connecting plates 402, and are respectively received in the first and second guide grooves 31, 32 of the respective first movement member 30 such that the each of the second movement members 40 can be pivotally provided on the respective first movement member 30 and such that each of the second movement members 40 can reciprocating displace within the guiding portions 31, 32 of the two first movement members 30 relative to the two first movement members 30.

The two linkage members 50 are substantially elongate rigid rod members, one end of which is pivotally provided on the base frame 10, with the other end pivotally disposed on the outer side of the connecting plate 402 on the inner side of the respective second movement member 40 such that the first movement members 30, the second movement members 40, the linkage members 50 and the base frame 10 can form a four-linkage mechanism.

Figure 3:
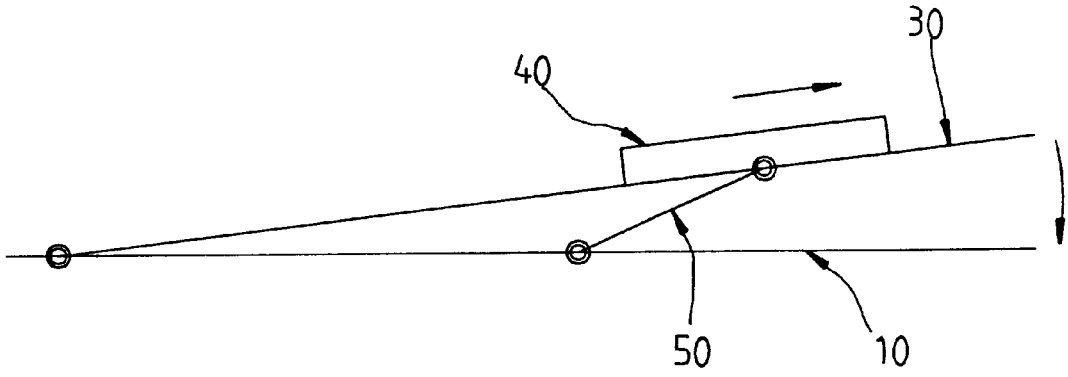
FIG. 3 is a schematic view illustrating operation of the invention.
Figure 4:
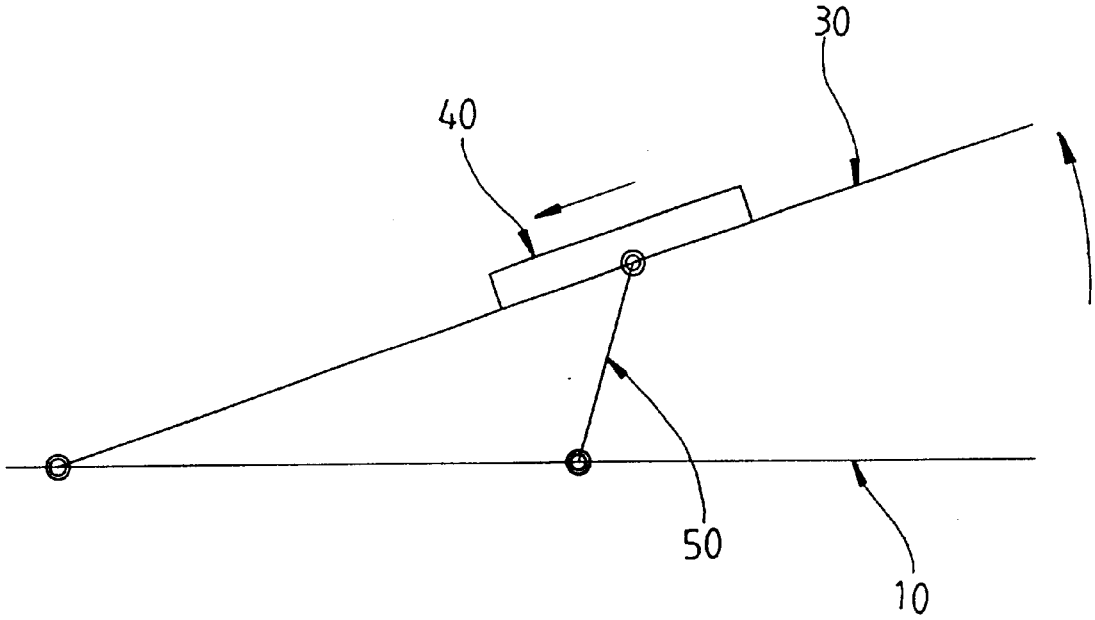
FIG. 4 is another schematic view illustrating operation of the invention.

Referring to FIG. 1, when the user uses both feet to work the pedals 40l of the second movement members 40, the first movement members 30 will move up and down. When one to the first movement members 30 is pressed downwardly. referring to FIG. 3., due to the action of the aforesaid four-linkage mechanism, the second movement members 40 will displace to the right relative to said first movement member 30, that is. the two guiding portions (pulleys) 41 of the second movement member 40 reach the right end of the guiding portions (guide grooves) 31 of said first movement member 40. And after said first movement member 30 moves upwardly, referring to FIG. 4, the second movement member 40 will move to the left relative to said first movement member 40. Therefore, the range of movement of the hiker 100 includes the up and down movement of the two first movement members 30 plus the sidewise displacement of the two second movement members 40 relative to the two first movement members 40. Hence, when the user utilizes the hiker 100 of the invention to exercise. he can exercise more parts of his body to thereby achieve a better exercising effect.

It is noted herein that:

1. The guiding portions on the first and second movement members are respectively guide grooves and pulleys disposed therein. In practice, the function of these guiding portions is to guide the two second movement members to perform reciprocating linear movement relative to the first movement members within a certain limit. Therefore, equivalent structures, such as guide grooves and slide blocks, are within the scope of the invention.

2. The linkage members are rigid rod members. In practice, the linkage members may be flexible belts or equivalents. The connecting points of the linkage members may vary depending on needs. In other words, the main function of the linkage members is that, when the first movement members displace, the second movement members are brought to displace relative to the first movement members. Any equivalent structure which is capable of achieving this function is within the scope of this invention.

3. Furthermore, the second movement members in the preferred embodiment have slanting pedals. In practice, the slanting angle of the foot pedals may be varied according to design choice so as to provide different tracks of movement.

4. Although the preferred embodiment of a foot-pedal type body exerciser of this invention is embodied in an exercise hiker, it can be applied to an exercising apparatus having pedals, such as a space Walker or elliptical apparatus, which should be deemed to fall within the scope of this invention.

In sum, the advantages of this invention reside in: The construction of the invention is simple, and the invention can allow the user to exercise more parts of his body so as to achieve a better exercising effect.

What is claimed is:

1. A foot-pedal type body exerciser, comprising:

a base frame;

at least one first movement member, one end of which is rotatably engaged on said base frame, each of said first movement members being provided with at least one guiding portion;

at least one resistance device provided on said base frame to provide a resistance to each of said first movement members;

at least one second movement member provided on each of said first movement members and adapted to be stepped on by a user so as to displace each of said first movement members; each of said second movement members having a guiding portion corresponding to said guiding portion of each of said first movement members such that each of said second movement members is capable of limited reciprocating displacement relative to each of said first movement members; and at least one linkage member having a first end provided on each of said second movement members, a second end thereof being provided at a predetermined position on said body exerciser such that when the user steps on each of said second movement members, each of said linkage members can bring each of said second movement members to displace relative to each of said first movement members.

2. The foot-pedal type body exerciser of claim 1, wherein said guiding portions of said first and second movement members are respectively elongate guide grooves and pulleys insertably disposed therein.

3. The foot-pedal type body exerciser of claim 1, wherein said second movement member has a top side having a pedal for stepping by the user, said pedal having a pedal face forming a predetermined angle with said first movement element.

4. The foot-pedal type body exerciser of claim 1, wherein said linkage member is a generally elongate rod member having the first end pivotally disposed on said second movement member, the second end thereof being pivotally disposed at a predetermined position on said base frame.

* * * * *